US009231324B2

(12) United States Patent
Hemmi et al.

(10) Patent No.: US 9,231,324 B2
(45) Date of Patent: Jan. 5, 2016

(54) TERMINAL

(71) Applicant: OMRON CORPORATION, Kyoto-shi (JP)

(72) Inventors: Yoshinobu Hemmi, Otsu (JP); Hirotada Teranishi, Osaka (JP)

(73) Assignee: OMRON CORPORATION, Kyoto-Shi, Kyoto (JP)

( * ) Notice: Subject to any disclaimer, the term of this patent is extended or adjusted under 35 U.S.C. 154(b) by 8 days.

(21) Appl. No.: 14/240,491

(22) PCT Filed: Oct. 12, 2012

(86) PCT No.: PCT/JP2012/076498

§ 371 (c)(1),
(2) Date: Feb. 24, 2014

(87) PCT Pub. No.: WO2013/054909

PCT Pub. Date: Apr. 18, 2013

(65) Prior Publication Data

US 2014/0315449 A1 Oct. 23, 2014

(30) Foreign Application Priority Data

Oct. 14, 2011 (JP) ..... 2011-227128

(51) Int. Cl.
*H01R 4/66* (2006.01)
*H01R 13/02* (2006.01)
*H01R 4/24* (2006.01)

(52) U.S. Cl.
CPC ..... *H01R 13/025* (2013.01); *H01R 4/242* (2013.01); *H01R 4/2425* (2013.01)

(58) Field of Classification Search
CPC ..... H01R 23/688; H01R 23/7068
USPC ..... 439/108, 60, 637, 636, 405
See application file for complete search history.

(56) References Cited

U.S. PATENT DOCUMENTS

| | | | | | |
|---|---|---|---|---|---|
| 3,289,148 | A | * | 11/1966 | Antes | 439/637 |
| 3,787,801 | A | * | 1/1974 | Teagno et al. | 439/855 |
| 5,088,934 | A | | 2/1992 | Chow et al. | |
| 5,556,306 | A | * | 9/1996 | Lin et al. | 439/637 |
| 2012/0108111 | A1 | * | 5/2012 | Koyama et al. | 439/746 |

FOREIGN PATENT DOCUMENTS

| | | | |
|---|---|---|---|
| DE | 8914739 | U1 | 2/1990 |
| DE | 9101351 | U1 | 4/1991 |
| DE | 202005014816 | U1 | 11/2005 |
| JP | 4179072 | A | 6/1992 |
| JP | 7226236 | A | 8/1995 |
| JP | 09232010 | A | 9/1997 |
| JP | 9312106 | A | 12/1997 |

(Continued)

OTHER PUBLICATIONS

A European Search Report from the corresponding European Patent Application No. 12840322.7 issued on May 7, 2015.

(Continued)

*Primary Examiner* — Phuongchi T Nguyen
(74) *Attorney, Agent, or Firm* — Shinjyu Global IP

(57) ABSTRACT

A terminal includes an insertion groove for pressing a conductor thereinto disposed between a pair of conductive arm parts, and a slit disposed proximate to the insertion groove.

4 Claims, 15 Drawing Sheets

(56) References Cited

FOREIGN PATENT DOCUMENTS

| | | | |
|---|---|---|---|
| JP | 5251115 | A | 3/2003 |
| JP | 200377552 | A | 3/2003 |
| JP | 3098197 | U | 9/2003 |
| JP | 2005209540 | A | 8/2005 |
| JP | 2011096628 | A | 5/2011 |

OTHER PUBLICATIONS

International Search Report for corresponding application PCT/JP2012/076499 filed Oct. 12, 2012; Mail date Jan. 8, 2013.

International Search Report for corresponding application PCT/JP2012/076497 filed Oct. 12, 2012; Mail date Jan. 8, 2013.

International Search Report for corresponding application PCT/JP2012/076498 filed Oct. 12, 2012; Mail date Jan. 15, 2013.

* cited by examiner (A)

Prior Art (B)

TERMINAL

CROSS REFERENCE TO RELATED APPLICATION

This application is the United States National Phase of International Patent Application Number PCT/JP2012/076498 filed on 12 Oct. 2012 which claims priority to Japanese Patent Application No. 2011-227128 filed on 14 Oct. 2011, all of which said applications are herein incorporated by reference in their entirety.

TECHNICAL FIELD

The present invention relates to a terminal where an electrical wire or the like is pressed into a U-shaped insertion groove, to be connected in relay connection of a censor or the like.

BACKGROUND ART

There have hitherto been provided a variety of terminals to be pressure-welded with an electrical wire, for use in a connector to connect the electrical wire.

Examples of such terminals include a terminal 103 in which an electrical wire 6 is pressed into an insertion part 102 provided with a U-shaped insertion groove 101 shown in FIG. 19(A). This terminal 103 was subjected to stress analysis of confirming a location of stress concentration and an amount of plastic deformation that occurs by a load by pressing the electrical wire 6 into the insertion part 102. It was found according to this stress analysis that stress concentrates on a region S.

FIG. 19(B) shows a result of the analysis of confirming the amount of plastic deformation, graphically representing a curve L indicative of the relation between the load applied to the insertion part 102 and the displacement amount thereby. Further, a straight line M is indicative of the relation between the applied load and the displacement amount with the insertion part 102 in an elastically deformed state. It is to be noted that the elastically deformed state refers to that the curve L is in a region of a straight line passing an origin, and this region is referred to as an elastic deformation region. The insertion part 102 of the terminal 103 is elastically deformed with the applied load up to a point P, but it is plastically deformed when the load further increases. For this reason, when the pressed-in electrical wire 6 is pulled out in a state where the applied load has reached a point Q, the insertion part 102 gets back along a straight line N parallel to the straight line M, to reach a point R. It was found from the above that this insertion part 102 is plastically deformed by pressing-in of the electrical wire 6.

As a terminal having the above configuration, a pressure-welding connector terminal, which is connected with an electrical wire via an insertion part provided with a U-shaped slit similarly to the above, is described in Japanese Unexamined Patent Publication No. H9-312106.

However, in the terminal described in this publication, the U-shaped slit is just provided in a platy insertion part, and the insertion part is thus apt to be plastically deformed when an electrical wire is pressed into the U-shaped slit, thus leading to deterioration in force of holding the electrical wire. There has thus been a problem of poor repairability at the time of reinserting and using the electrical wire.

Further, when the strength of the insertion part is enhanced for ensuring predetermined force of holding the electrical wire, spring force of the insertion part needs increasing, thus causing a problem of making the U-shaped slit difficult for pressing-in of the electrical wire.

BRIEF SUMMARY

The present invention has been made in view of the above conventional problems, and provides a terminal which does not require a large amount of applied load at the time of pressing-in of an electrical wire and can avoid plastic deformation that occurs by the pressing-in of the electrical wire, thus ensuring the repairability at the time when the electrical wire is pulled out of an insertion groove and reinserted thereinto to be used.

The invention provides a terminal including an insertion groove for pressing a conductor thereinto disposed between a pair of conductive arm parts, and a slit disposed proximate to the insertion groove

BRIEF DESCRIPTION OF THE DRAWINGS

FIG. 6(A) is a perspective view showing a modified example where a linear slit is formed, and FIG. 6(B) is a perspective view showing a modified example where a circular slit is formed.

FIG. 7(A) is a perspective view showing a modified example where a substantially U-shaped slit is provided in the conductive arm part, and FIG. 7(B) is a perspective view showing a modified example where a linear slit is provided in the terminal of FIG. 7(A).

FIG. 8(A) is a front view showing a modified example where a triangular through hole is provided in the conductive arm part, and FIG. 8(B) is a perspective view of FIG. 8(A).

FIG. 9(A) is a front view showing a modified example where an inclined surface is provided in the conductive arm part of FIG. 12(A), and FIG. 9(B) is a perspective view of FIG. 9(A).

FIG. 10(A) is a front view showing a modified example where a long slit and a short slit are provided in the conductive arm part, and FIG. 10(B) is a perspective view of FIG. 10(A).

FIG. 11(A) is a front view showing a modified example where a substantially U-shaped slit is provided in the conductive arm part, and FIG. 11(B) is a perspective view of FIG. 11(A).

FIG. 15(A) is a front view showing a modified example where a pressing-in notch is formed in a contact part, and FIG. 15(B) is a partially enlarged view of FIG. 15(A).

FIG. 17(A) is a perspective view in a state where the insertion part of the present invention is applied to a card edge/plug-in connector for inserting an extension card of a PC thereinto, and FIG. 17(B) is a perspective view showing a modified example of FIG. 17(A).

FIG. 18(A) is a perspective view in a state where the insertion part of the present invention is applied to a connector connection terminal for connecting a flexible print substrate, and FIG. 18(B) is a perspective view showing a modified example of FIG. 18(A).

DETAILED DESCRIPTION

Figure 1:
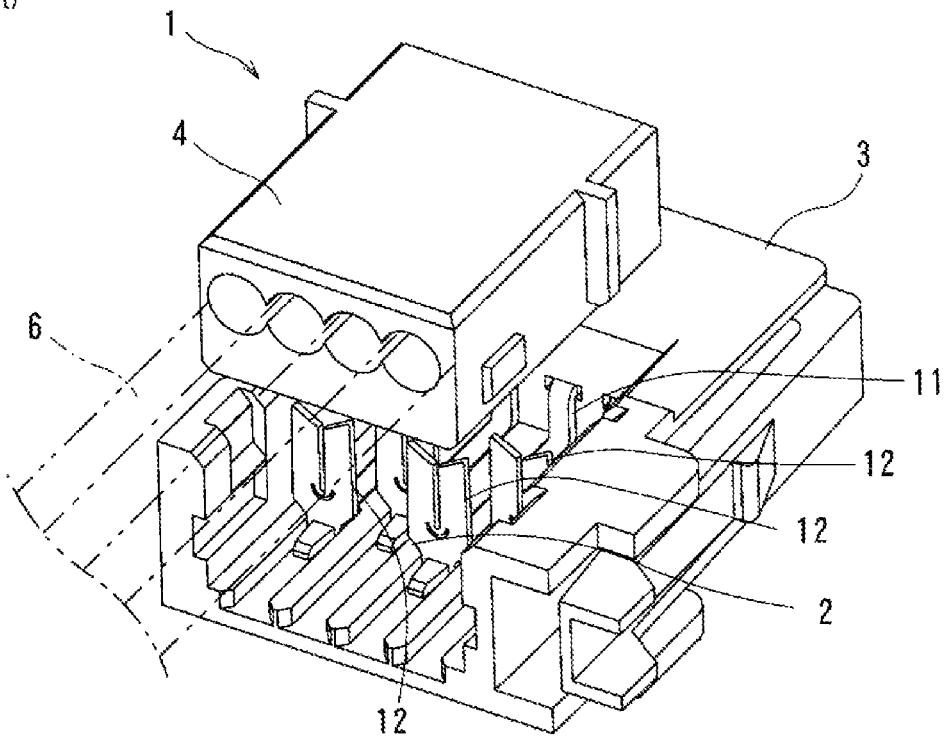
FIG. 1(A) is a perspective view showing a connector in a state where a housing mounted with a terminal according to First Embodiment of the present invention and a header with an electrical wire integrated therein are separated from each other.
FIG. 1(B) is a perspective view showing a connector in a state where the housing and the header of FIG. 1(A) are fitted with each other.
Figure 1:
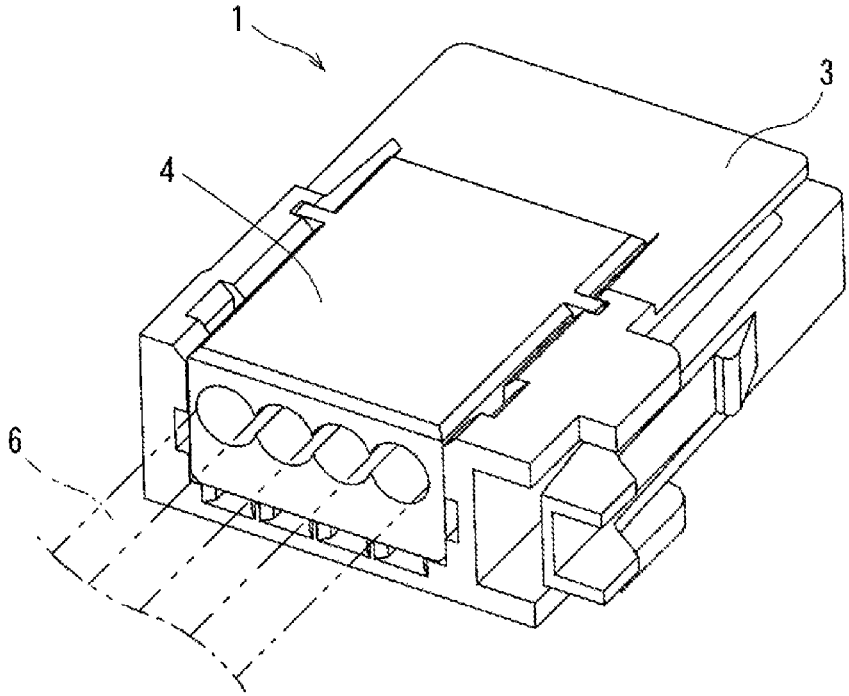
Figure 2:
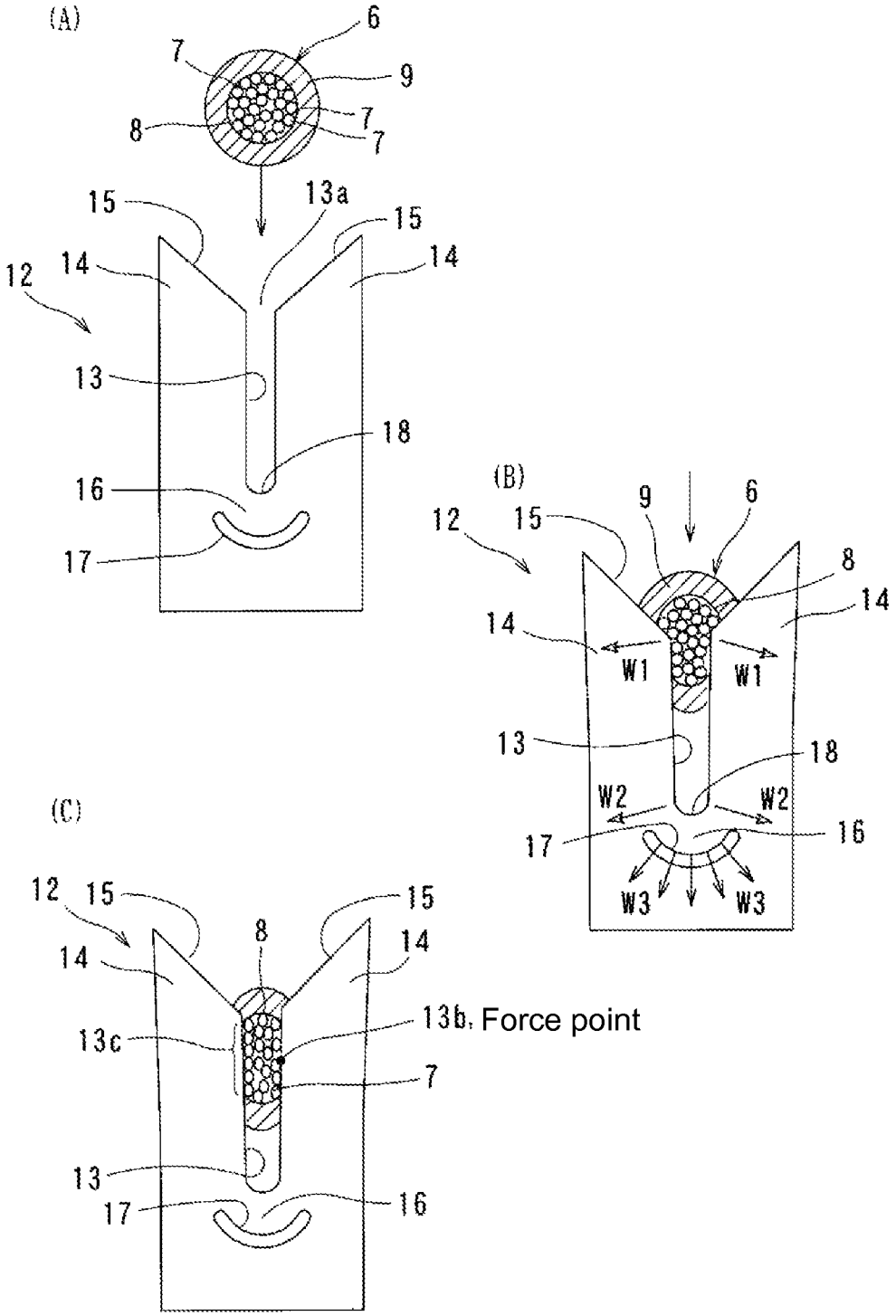
FIG. 2(A) is a front view before pressing of an electrical wire into an insertion part.
FIG. 2(B) is a front view in a state where the electrical wire is pressed into an opening of the insertion part.
FIG. 2(C) is a front view in a state where the electrical wire is pressed into the insertion groove of the insertion part.

Hereinafter, embodiments of the terminal according to the present invention will be described in accordance with FIGS. 1 to 18.

In a First Embodiment, as shown in FIGS. 1(A) and 1(B), a connector 1 is made up of: a housing 3 which is mounted such that an insertion part 12 of a terminal 11 is located at an opening 2; and a header 4 with an electrical wire 6 integrated therein. Then, the header 4 is fitted into the opening 2 of the housing 3, to connect the insertion part 12 with the electrical wire 6.

Specifically, as shown in FIG. 2(A), the insertion part 12 of the terminal 11 is provided with: a U-shaped insertion groove 13 for pressing the electrical wire 6 thereinto and holding it; a pair of conductive arm parts 14 which are symmetrically formed with this insertion groove 13 provided therebetween; and a peeling part 15 which is formed so as to be open outward toward the upside for removing a later-mentioned coated layer 9 of the electrical wire (conductor) 6. An arc-like slit 17 curved downward is provided in a base 16 located near an end 18 of the insertion groove 13.

Next, an operation of pressing the electrical wire 6 into the insertion groove 13 will be described with reference to FIGS. 2(B) and 2(C).

The electrical wire 6 has a twisted line 8 bundling a plurality of single lines 7, and a coated layer 9 made up of a resin coating a periphery of this twisted line 8. Upon pressing-in of the electrical wire 6 from the upper portion of the insertion part 12, first, the coated layer 9 is removed by the peeling part 15 and the twisted line 8 is exposed.

When the electrical wire 6 is further pressed downward in the insertion groove 13, the twisted line 8 is guided downward while expanding the conductive arm part 14 obliquely downward by a load W1 (see FIG. 2(B)), and by reaction force thereof, the single line 7 begins to be deformed. Further, a load W2 is applied obliquely downward to each end of the end 18 of the insertion groove 13. However, with the slit 17 provided in the present invention, stress W3 generated in the base 16 is dispersed via the slit 17, making the base 16 of the insertion groove 13 apt to be elastically deformed. Hence it is possible to prevent stress concentration on a specific place of the insertion part 12, so as to reduce plastic deformation. Accordingly, even when the electrical wire 6 is once pulled out of the insertion groove 13 and reinserted thereinto, the holding force does not decrease, and the repairability can be held.

Then, the twisted line 8 pressed into the insertion groove 13 is pushed thereinto with the single lines 7 in the state of being undone from the bundle and densely provided within the insertion groove 13 (see FIG. 2(C)). At this time, the twisted line 8 expands the conductive arm part 14 outward from a center 13*b* (force point) of a contact part 13*c*, while each of the single lines 7 is plastically deformed by reaction force from the conductive arm part 14 and comes into contact with the conductive arm part 14 to be electrically conducted therewith.

Figure 3:
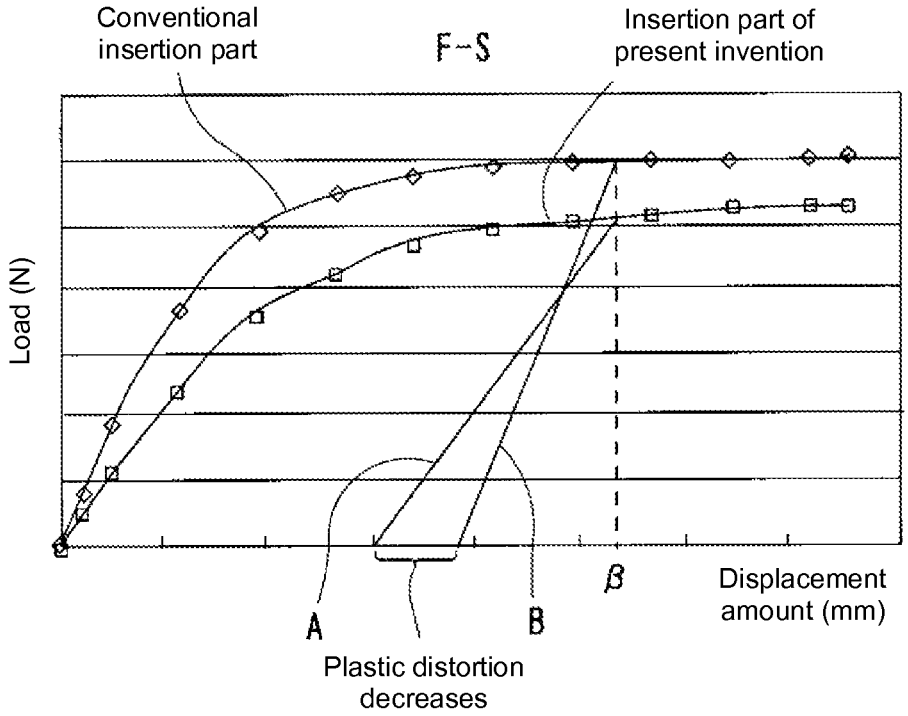
FIG. 3 is a graph showing the relation between each of loads, respectively applied to the insertion part of the present invention and a conventional insertion part, and a displacement amount thereby.
Figure 4:
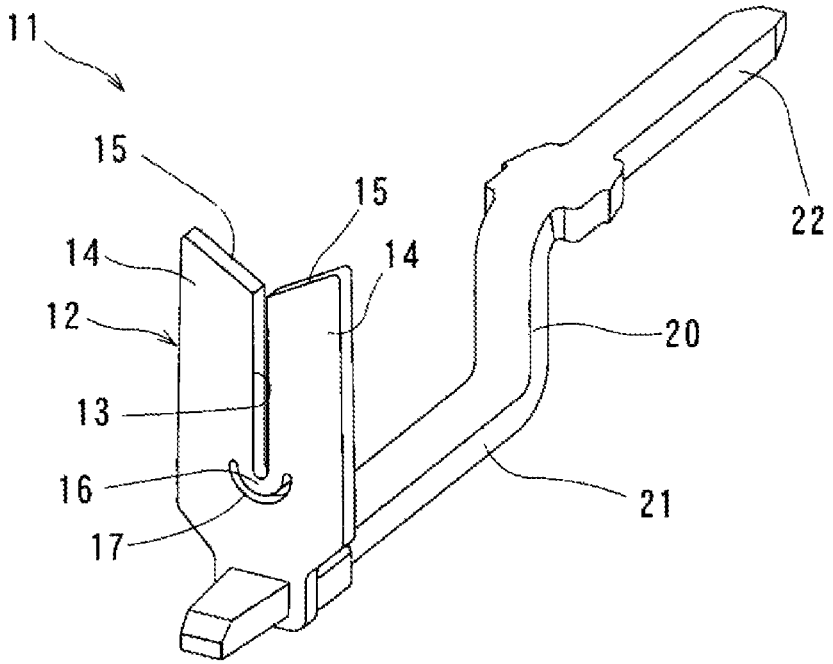
FIG. 4(A) is a perspective view of the terminal of FIG. 1.
FIG. 4(B) is a perspective view showing a modified example of the terminal of FIG. 4(A).
Figure 4:
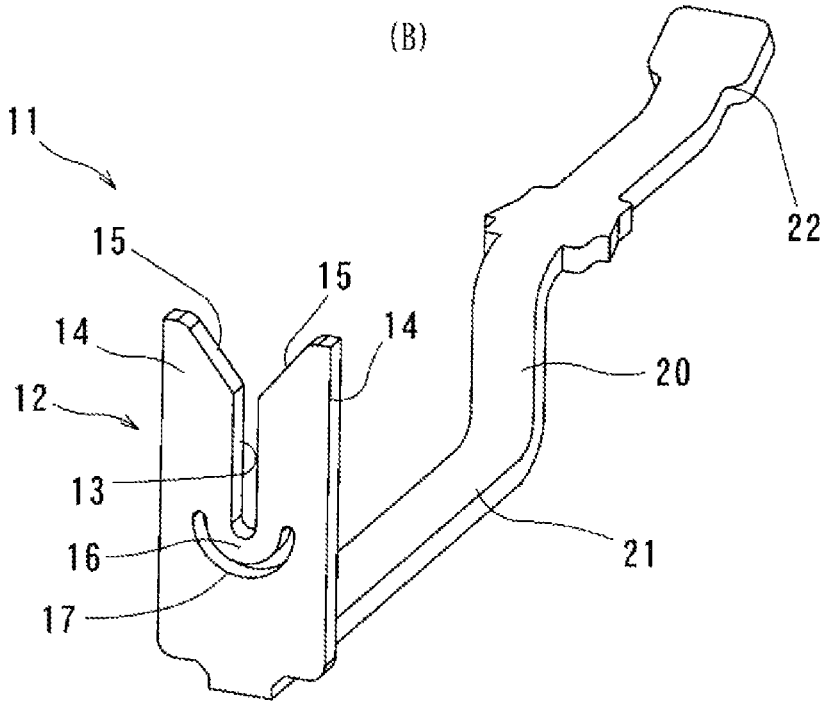
Figure 5:
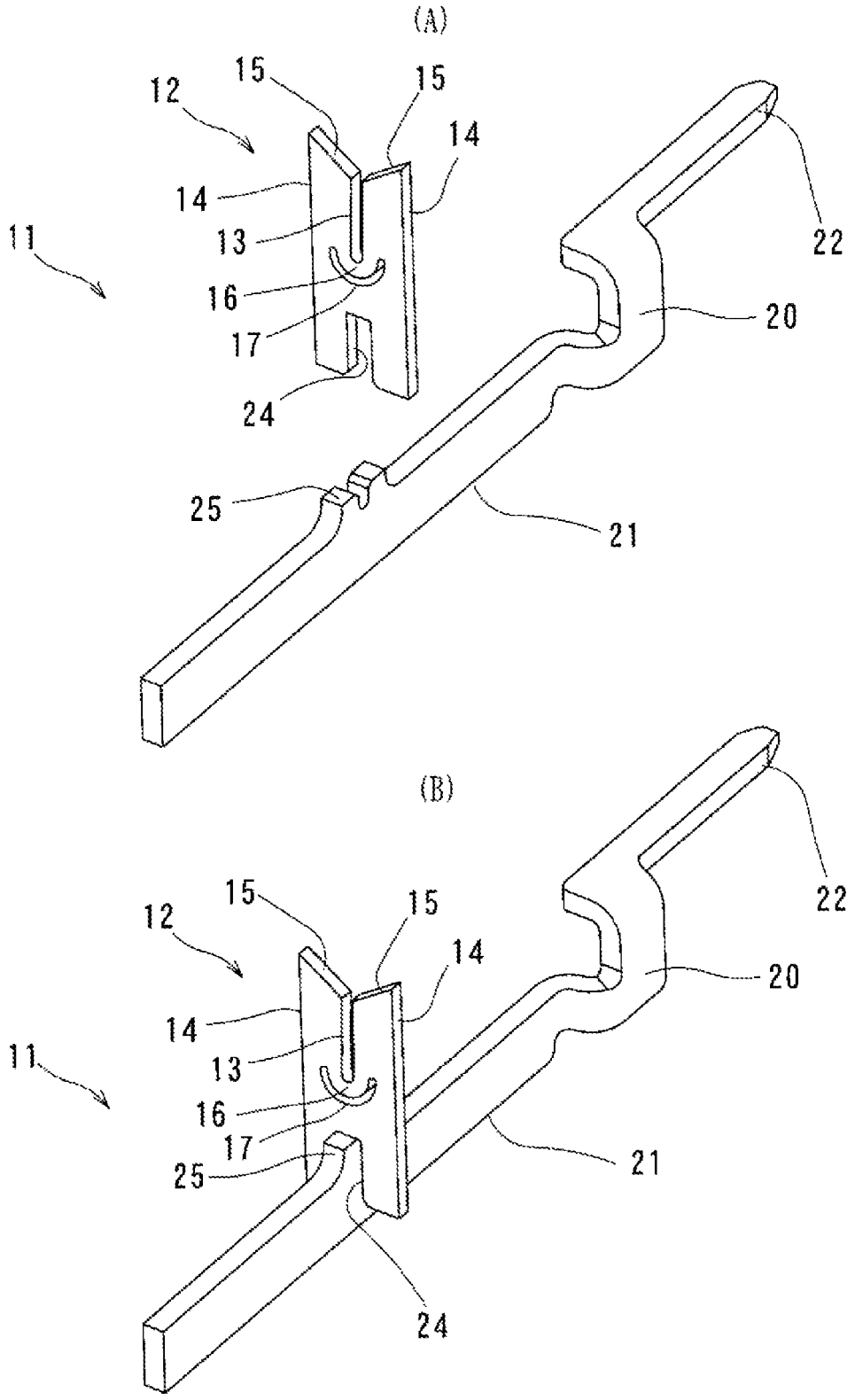
FIG. 5(A) is a perspective view showing a modified example of the terminal in a state where the insertion part is separated from a conductive part.
FIG. 5(B) is a perspective view showing a state where the insertion part is joined with the conductive part in FIG. 5(A).
Figure 6:
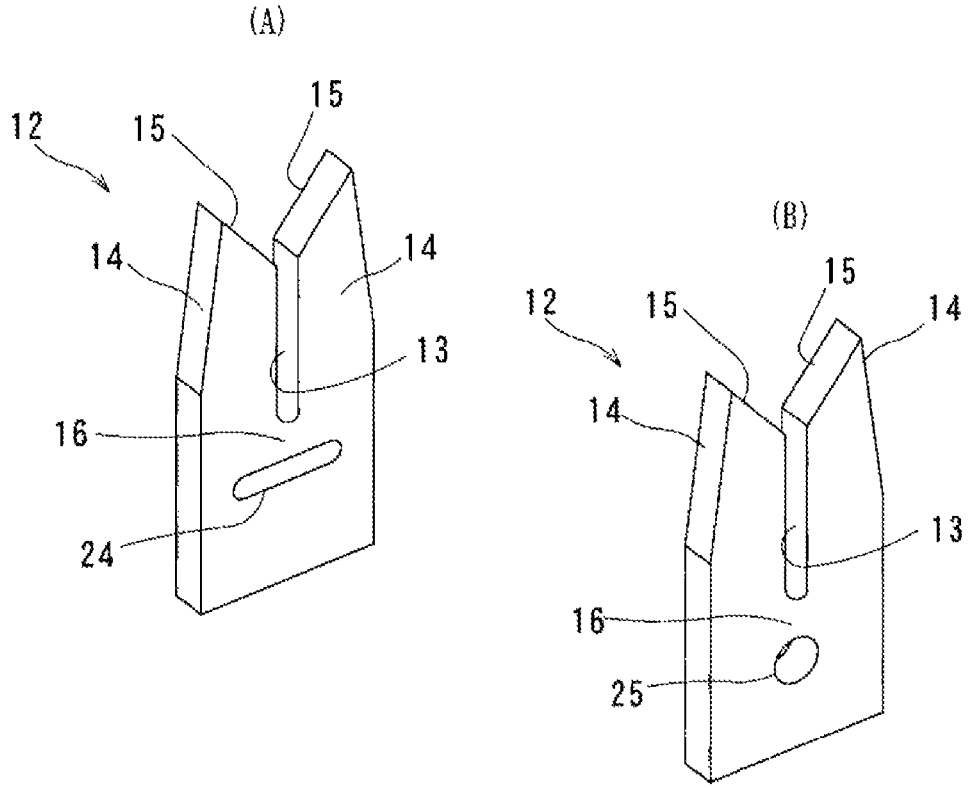
FIGS. 6(A) and 6(B) show a terminal according to a modified example of First Embodiment.
Figure 7:
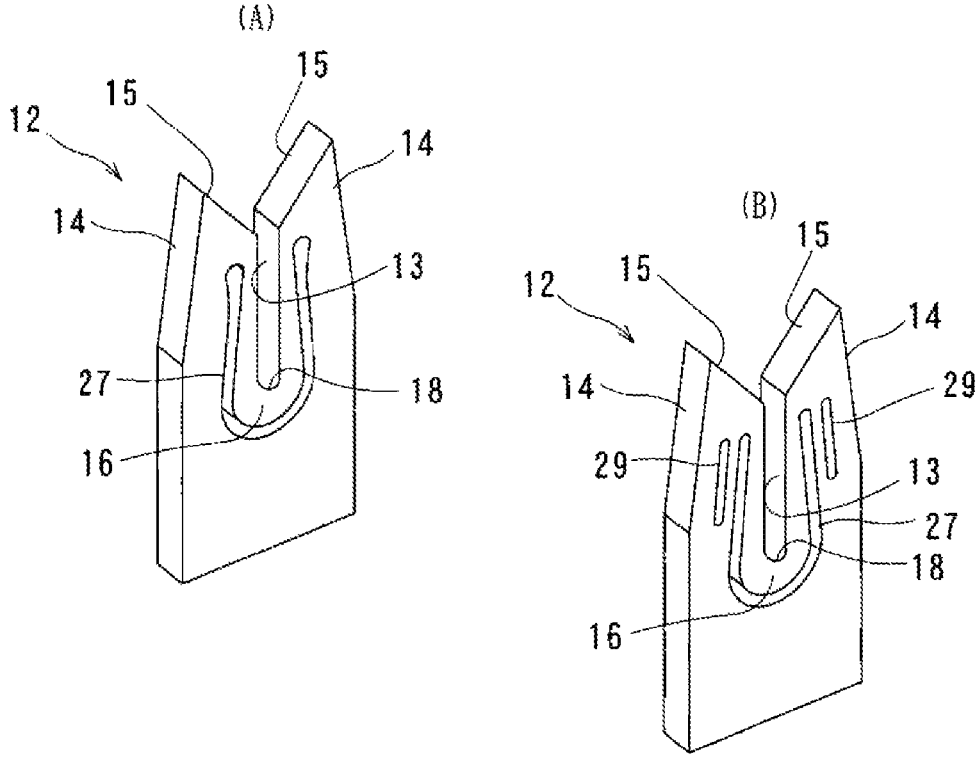
FIGS. 7(A) and 7(B) show a terminal according to Second Embodiment.
Figure 8:
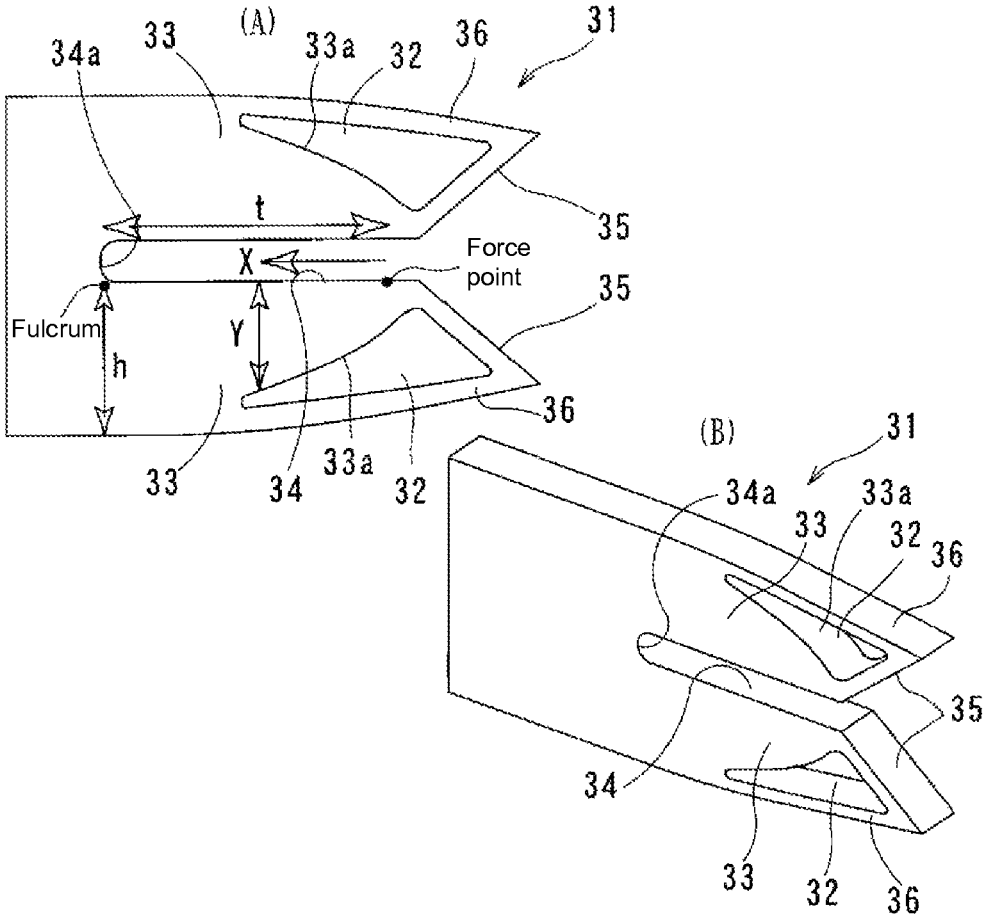
FIGS. 8(A) and 8(B) show a terminal according to Third Embodiment.
Figure 9:
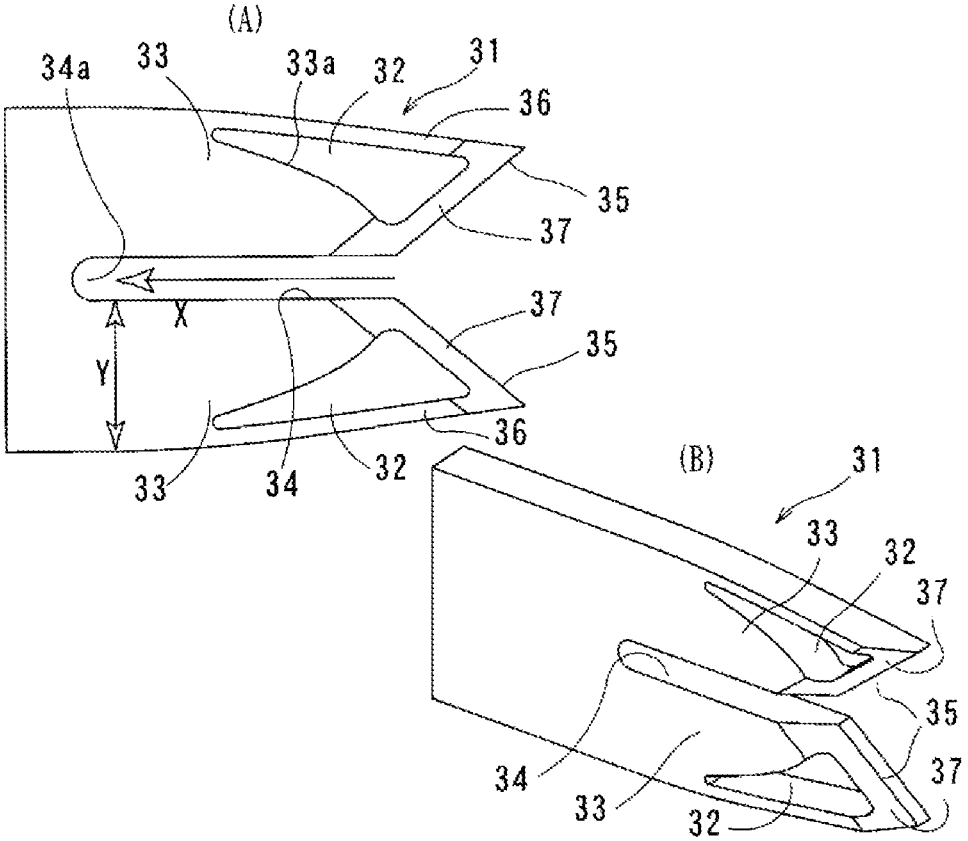
FIGS. 9(A) and 9(B) show a terminal according to a modified example of Third Embodiment.
Figure 10:
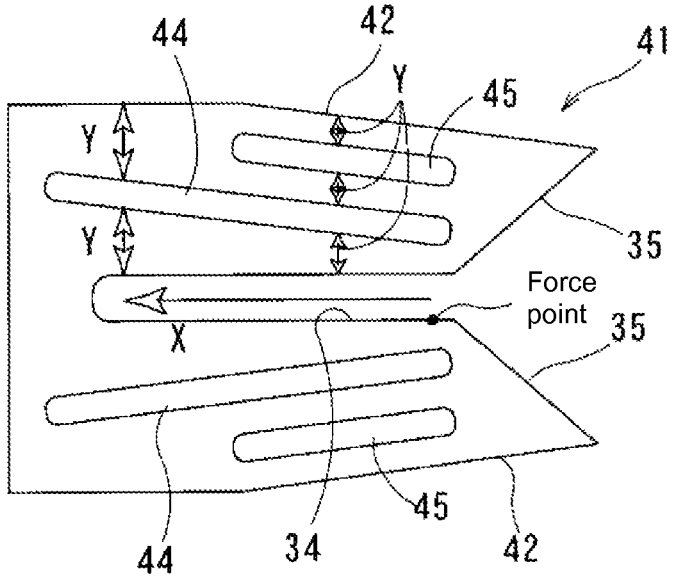
FIGS. 10(A) and 10(B) show a terminal according to Fourth Embodiment.
Figure 10:
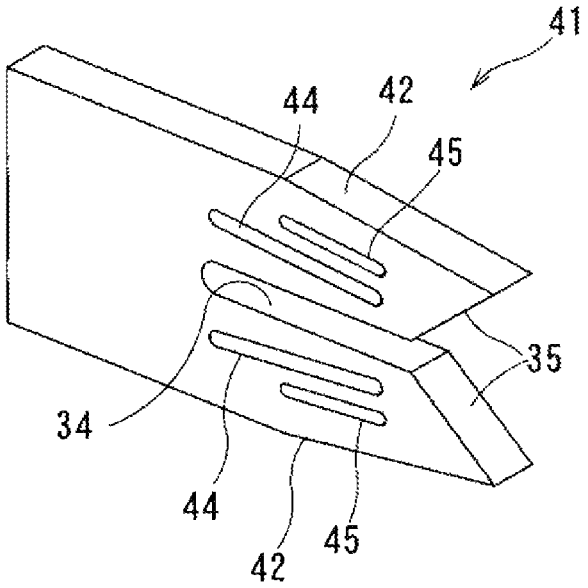
Figure 11:
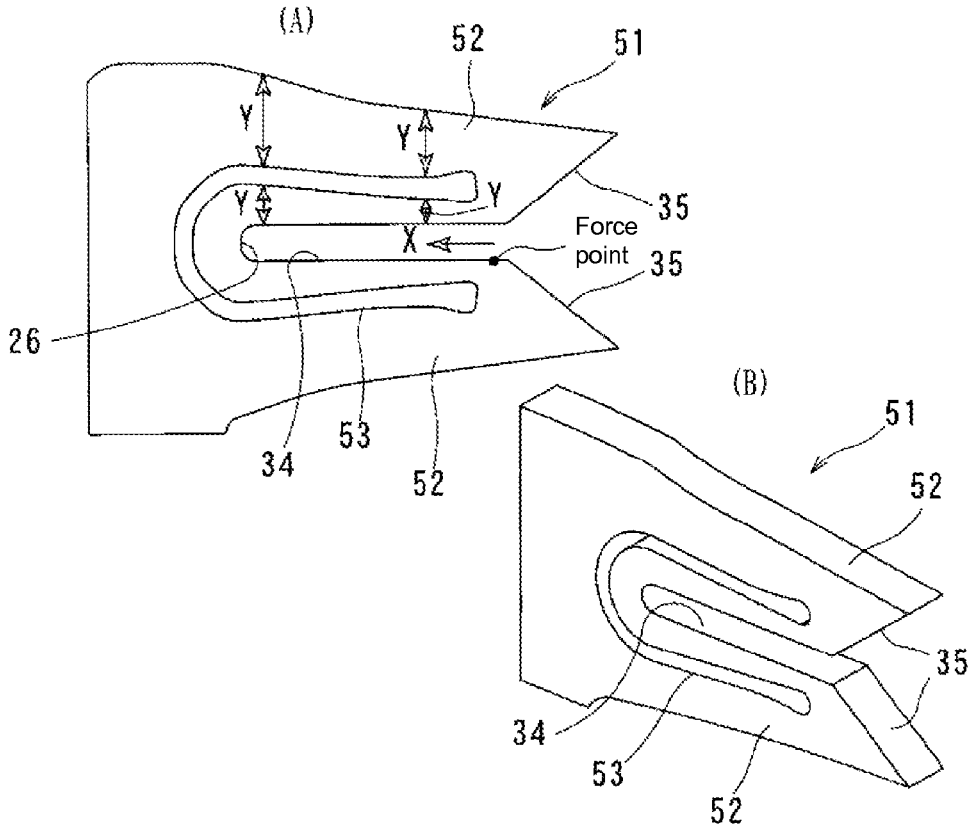
FIGS. 11(A) and 11(B) show a terminal according to Fifth Embodiment.
Figure 19:
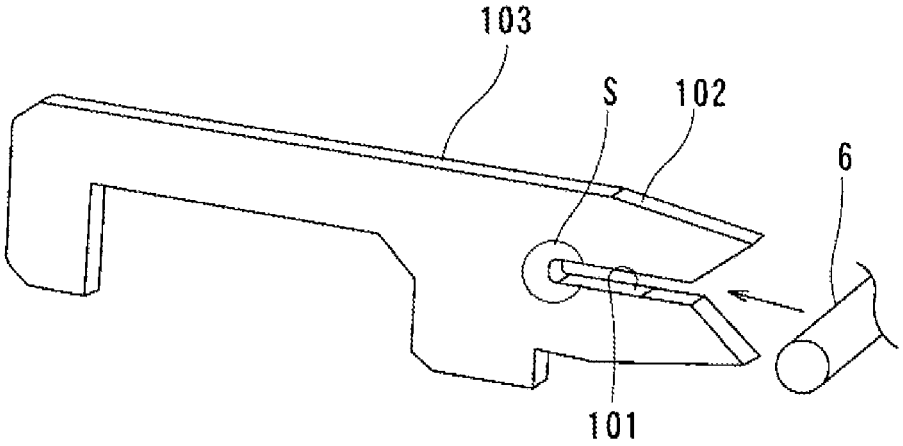
Fig. 19 Prior Art
FIG. 19(A) is a perspective view of the conventional terminal.
FIG. 19(B) is a graph showing the relation between a load applied to an insertion part of FIG. 19(A) and a displacement amount thereby.
Figure 19:
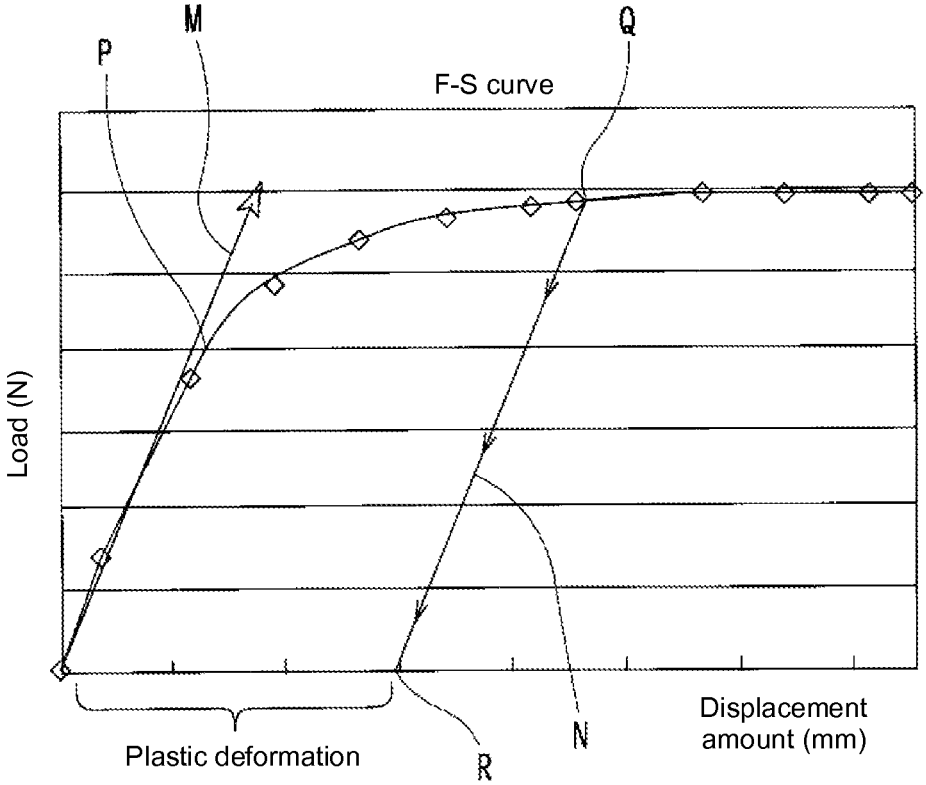
Fig. 19 Prior Art

The present inventors conducted analysis of applying a load to each of the insertion part 12 according to the present invention and the conventional insertion part shown in FIG. 19(A). FIG. 3 shows analysis results. FIG. 3 is a graph showing the relation between each of loads, respectively applied to the insertion part 12 of the present invention and the conventional insertion part, and a displacement amount thereby.

According to the present analysis results, the inclination at the time of elastic deformation is small in the insertion part 12 of the present invention as compared with the conventional insertion part. Namely, it is found that the insertion part 12 of the present invention is apt to be elastically deformed and is not apt to be plastically deformed. Therefore, when the electrical wire 6 is pulled out in a state where the displacement of each insertion part has reached β, the insertion part 12 of the present invention gets back into the original shape along a straight line A. On the other hand, in the conventional insertion part, it gets back along a straight line (B). Hence it was confirmed that the insertion part 12 of the present invention can reduce plastic deformation and ensure the repairability.

Further, it is found that, when the insertion part 12 of the present invention and the conventional insertion part are to be displaced in the same amount, the insertion part 12 of the present invention is displaced by a small load as compared with the conventional insertion part. It was thus found that the load required at the time of pressing the electrical wire 6 into the insertion groove 13 becomes small, and the electrical wire 6 becomes easy for pressing-in.

As shown in FIG. 4(A), the terminal 11 provided with the insertion part 12 according to First Embodiment has: a conductive part 21 formed with a step 20 at the center; the insertion part 12 which is fitted to one end of this conductive part 21 and is erected in a vertical direction; and a plug part 19 which is formed at the other end of the conductive part 21 and is fitted with an external contact.

It is to be noted that in the present embodiment, although the insertion part 12 as a separate body is fitted to the end of the conductive part 21, the insertion part 12 and the conductive part 21 may be provided in a unified manner (see FIG. 4(B)).

Further, as shown in FIGS. 5(A) and 5(B), a configuration may be formed where a rectangular notch 24 is provided at the bottom of the insertion part 12, and this notch 24 is engaged into a concave-shaped projection 25 formed on the upper surface of the conductive part 21, to connect the insertion part 12 to the conductive part 21.

Naturally, the insertion part of the present invention is not restricted to the above embodiment, and a variety of shapes can be adopted so long as the slit is provided in at least some part around the insertion groove.

A modified example of the First Embodiment is a case where, in place of the arc-like slit 17, a linear slit 4 98 is provided which extends in a horizontal direction and each end of which is formed in a semicircular shape, as shown in FIG. 6(A). Similarly, a circular slit 99 may be provided as shown in FIG. 6(B).

A second Embodiment is a case where a substantially U-shaped slit 27 (first slit) is provided which surrounds the end 18 of the insertion groove 13 and extends on both sides of the insertion groove 13, as shown in FIG. 7(A). This facilitates elastic deformation of the conductive arm part 14 to allow prevention of plastic deformation that occurs at the time of applying a load to the opening of the insertion groove 13, while allowing prevention of stress concentration in the base 16.

A modified example of the Second Embodiment is a case where a linear slit (second slit) 29, whose end is formed in a semicircular shape, is provided on the outer side of the substantially U-shaped slit 27 along the outer shape of a conductive arm part 14, as shown in FIG. 7(B). This can further facilitate elastic deformation.

A third Embodiment is a case where the insertion part 31 is provided with: a conductive arm part 33; a peeling part 35; and a reinforcing part 36 which is provided between the conductive arm part 33 and the end of the peeling part 35, as shown in FIGS. 8(A) and 8(B). An outer edge 33*a* of the conductive arm part 33 is formed as a beam having uniform strength, with which stress is constant on any cross section. The peeling part 35 is provided so as to be open outward from the end of the conductive arm part 33. In this insertion part 31, the curved outer edge (one side of the through hole 32) 33*a* of the conductive arm part 33, the peeling part 35 and the reinforcing part 36 form a substantially triangular through hole (slit) 32.

X represents a distance from the center (force point) of the contact part between the conductive arm part 33 and the electrical wire 6 to the inside of an insertion groove 34 at the time of pressing-in of the electrical wire 6, Y represents a width of the conductive arm part 33 at the point reached by moving just the distance X, and Z represents a section modulus at a point of the distance X. At this time, as for the conductive arm part 33, the width Y of the conductive arm part 33 is decided such that the section modulus Z is proportional to the distance X, namely a width Y2 is proportional to the distance X. Accordingly, even when the electrical wire 6 is pressed into the insertion groove 34, stress a generated throughout the conductive arm part 33 is constant, and hence the stress a is not biased to a specific place of the conductive arm part 33. Hence it is possible to reduce plastic deformation and plastic distortion that occur in the conductive arm part 33, while reducing a decrease in holding force due to exhaustion even when the electrical wire is once pulled out of the insertion groove 34 and reinserted thereinto, so as to hold the repairability. Further, the shape of the conductive arm part 33 is simplified, thereby facilitating production of the terminal and allowing reduction in production cost thereof.

It is to be noted that the shape of the conductive arm part 33 is not restricted to that of the beam with uniform strength, and it may be a shape approximate to that of the beam with uniform strength. Further, when t represents a distance from the force point to an end 34*a* of the conductive arm part 33 and h represents the maximum width at a fulcrum provided at the end 34*a* of the conductive arm part 33, the following formula holds.

$$\text{when } X=(1/2)\times t, \text{ at a point of } X, Y=(h/\sqrt{2})\times(0.8 \text{ to } 1.2).$$

At this time, stress that is applied to the conductive arm part 33 can be efficiently dispersed.

Further, a modified example of the Third Embodiment is a case where an inclined surface 37 which is inclined parallel to the end surface of the peeling part 35 is formed on the peeling part 35 of the insertion part 31, as shown in FIGS. 9(A) and 9(B). This is advantageous in that the coated layer 9 of the electrical wire 6 can be removed with ease and the electrical wire 6 can be pressed into the insertion groove 34 by a smaller load.

A fourth Embodiment is a case where a long slit 44 is provided in the vicinity of the insertion groove 34 of a conductive arm part 42 and a short slit 45 is provided on the outer side of this slit 44 along the outer shape of the conductive arm part 42, as shown in FIGS. 10(A) and 10(B). Therefore, a sectional area of the conductive arm part 42 can be changed while the thickness thereof remains uniform, and the section modulus Z is proportional to the distance X, whereby it is possible to obtain a similar effect to the above. Further, the slits 44, 45 are linearly provided, thereby facilitating production and allowing reduction in production cost. It is to be noted that the number of slits is not restricted to two, and it may be plural being three or larger, and in this case, a similar effect can be obtained by providing the longest slit 41 in the vicinity of the insertion groove 34 and disposing the plurality of slits such that the lengths thereof sequentially become shorter as being more distant from the insertion groove 34.

A fifth Embodiment is a case where a substantially U-shaped slit (first slit) 53, which extends along the insertion groove 34 and surrounds the end 26 of the insertion groove 34, is provided in a conductive arm part 52 of an insertion part 51, as shown in FIGS. 11(A) and 11(B). Further, an outer shape of this conductive arm part 52 is curved such that the width Y orthogonal to the insertion groove 34 increases in accordance with the distance X, thereby forming the beam with uniform strength having a width Y2 proportional to the distance X. Therefore, the conductive arm part 52 becomes apt to be elastically deformed, thereby to allow prevention of stress concentration.

Figure 12:
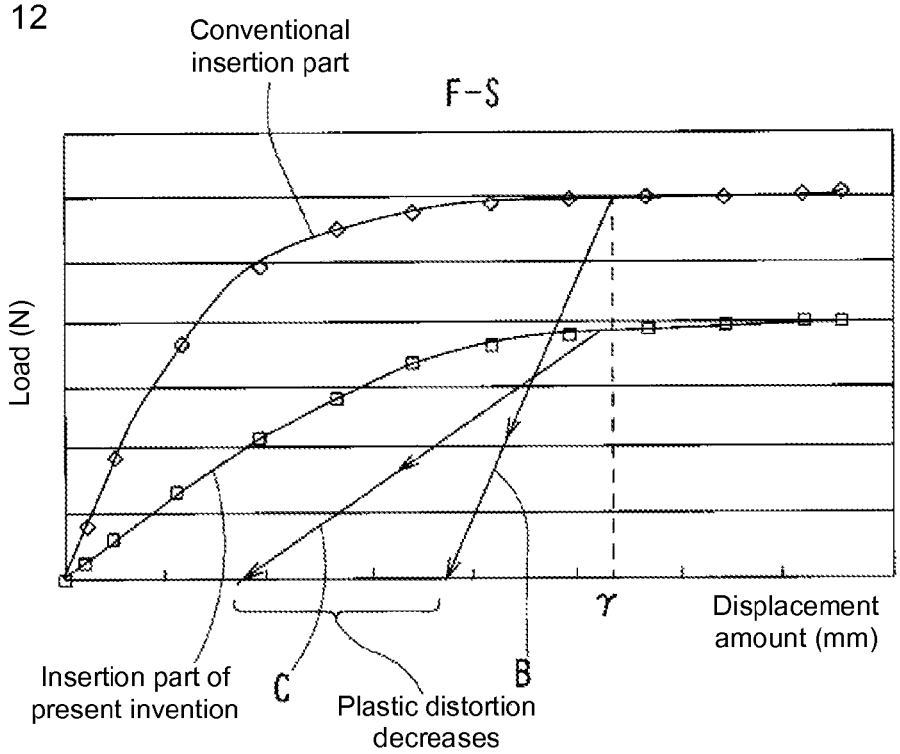
FIG. 12 is a graph showing the relation between each of loads, respectively applied to the insertion part of FIGS. 11(A) and 11(B) and a conventional insertion part, and displacement amount thereby.

FIG. 12 shows results of analysis of applying a load to each of the insertion part 51 having the conductive arm part 52 and the conventional insertion part shown in FIG. 19(A). According to this, the inclination of the elastic deformation region is significantly small in the insertion part 51 of the present invention as compared with the conventional insertion part. When the electrical wire 6 is pulled out in a state where the displacement of each insertion part has reached γ, the insertion part 51 of the present invention gets back into the original shape along a straight line C.

On the other hand, the conventional insertion part gets back into the original shape along a straight line B. Since the insertion part 51 of the present embodiment is apt to be elastically deformed and is significantly reduced in plastic distortion, it was confirmed that the repairability can be reliably held.

Figure 13:
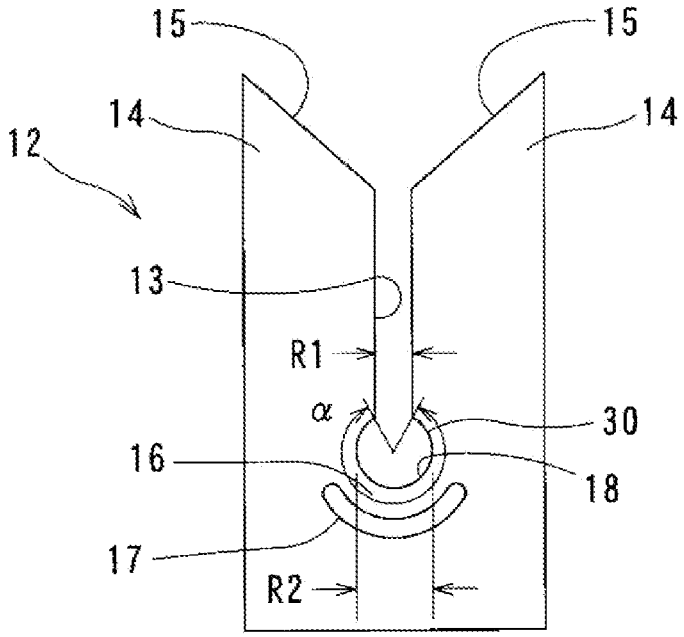
FIG. 13 is a front view showing a terminal according to Sixth Embodiment, and showing a modified example where an arc-like notched part is provided in the insertion groove.

As a sixth Embodiment, an arc-like notched part 30 with an angle α over 180° is provided at the end 18 of the insertion groove 13, as shown in FIG. 13. A diameter R2 of this arc-like notched part 30 is larger than a width R1 of the insertion groove 13. Therefore, by application of a load, force of a vertical component and vertical force generated by the load cancel each other, out of a horizontal component and the vertical component of force generated at each end of the arc-like notched part 30, and hence it is possible to prevent stress concentration at the end 18 of the insertion groove 13.

Figure 14:
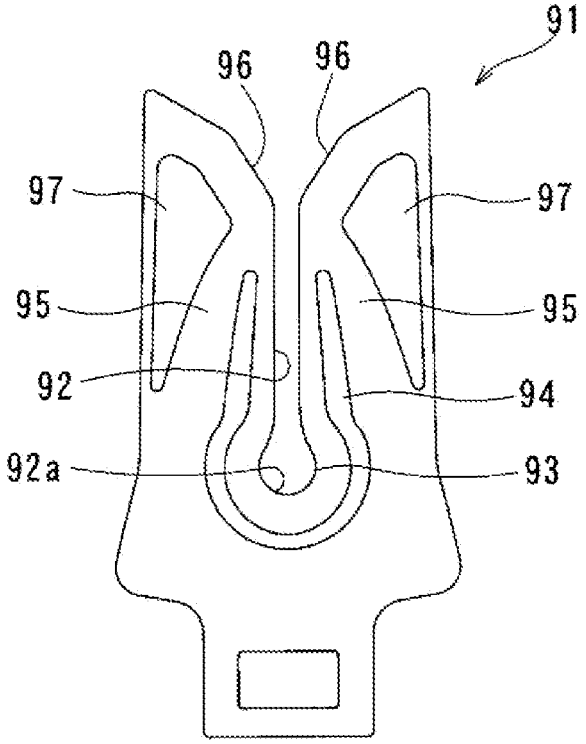
FIG. 14 is a front view showing a terminal according to Seventh Embodiment, and showing a modified example where an arc-like notch, a through hole and a substantially U-shaped slit are provided in the insertion part.
Figure 15:
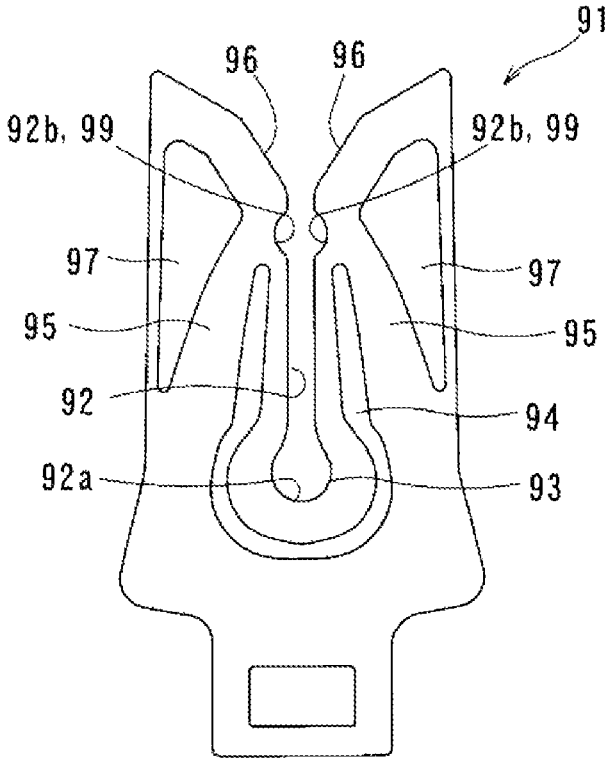
FIGS. 15(A) and 15(B) show a terminal according to Eighth Embodiment.
Figure 15:
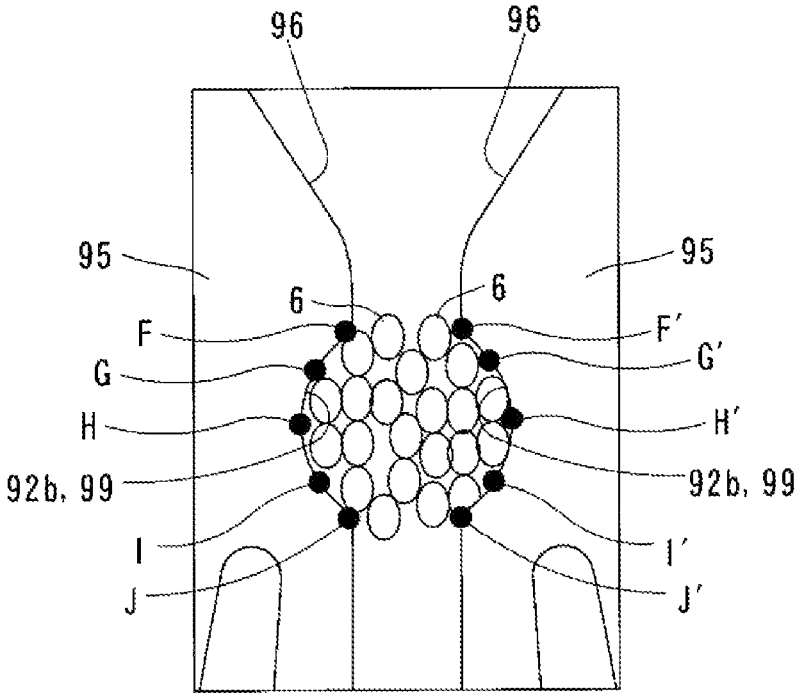

A seventh Embodiment is a case where an insertion part 91 is provided with an arc-like notched part 93 formed at an end 92*a* of an insertion groove 92; a substantially U-shaped slit 94 surrounding this arc-like notched part 93 and extending along the insertion groove 92; and a substantially triangular through hole (slit) 97, as shown in FIG. 14. Hence the conductive arm part 95 can be regarded as two spring bodies (elastic bodies) separated by the substantially U-shaped slit 94, so as to further reduce plastic deformation.

Further, a pair of pressing-in notches 99 may be formed in positions (contact parts 92*b* with the electric wire 6) opposed to the insertion groove 92, as in the Eighth Embodiment shown in FIGS. 15(A) and 15(B). This pressing-in notch 99 has an arc shape curved outward. In addition, although the pair of pressing-in notches 99 has been formed in the present embodiment, this is not restrictive, and either one of the pressing-in notches 99 may be provided. Further, a shape of the pressing-in notch 99 is not particularly restricted, and may only be such a shape as to allow the electric wire 6 to be pressed and fixed thereinto.

Figure 16:
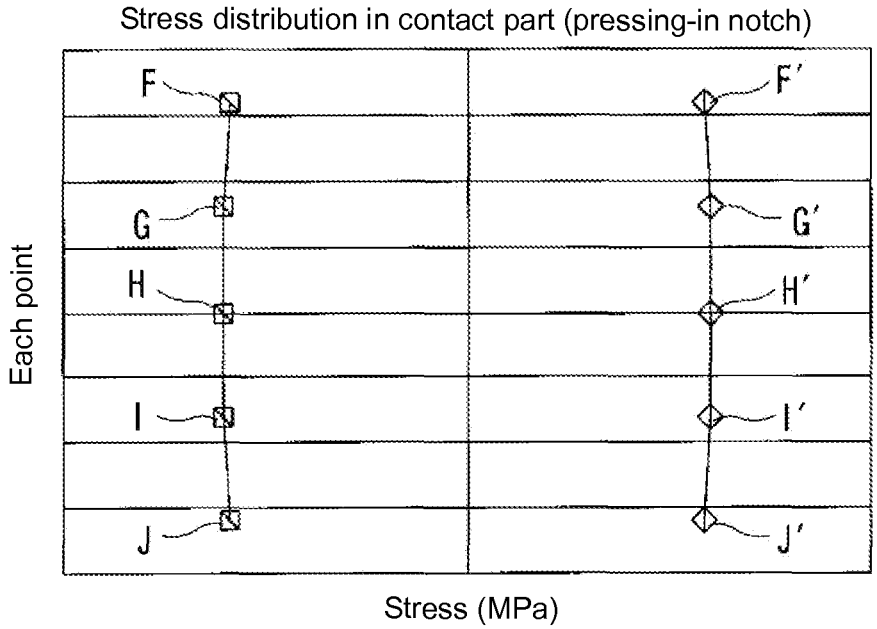
FIG. 16 is a graph showing reaction force from an electrical wire which is distributed to each point of the pressing-in notch.
Figure 17:
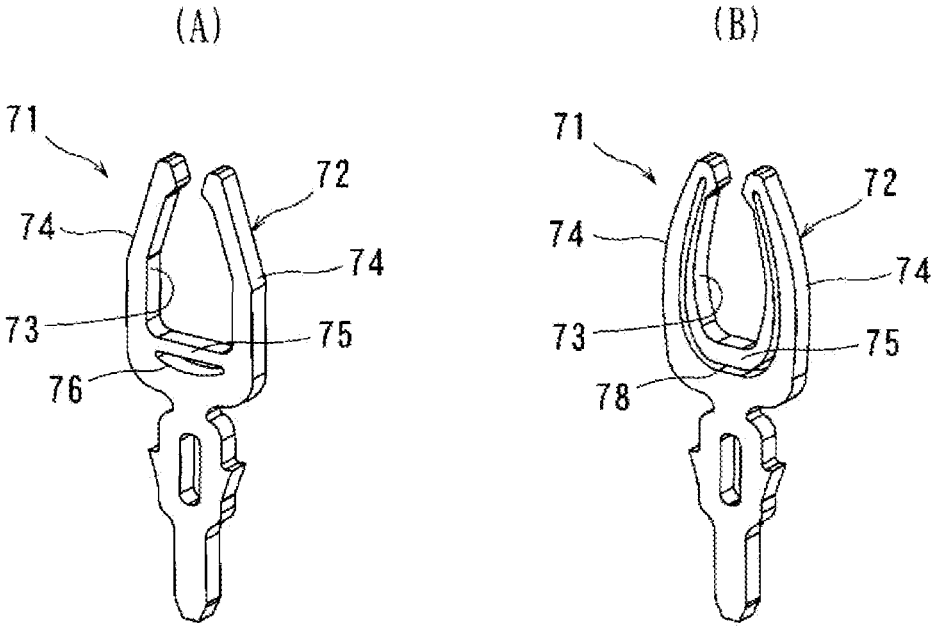
FIGS. 17(A) and 17(B) show a terminal according to Ninth Embodiment.
Figure 18:
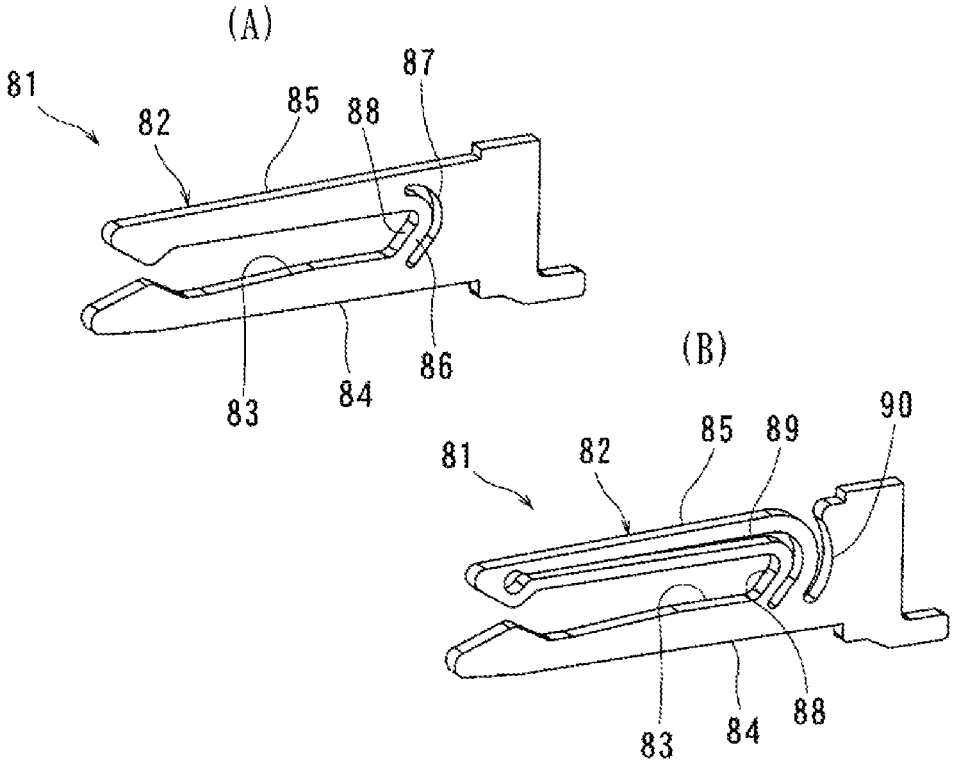
FIGS. 18(A) and 18(B) show a terminal according to Tenth Embodiment.

The present inventors conducted analysis of reaction force from each of the electric wire 6 distributed to points, F, F', G, G', H, H', I, I', J and J' of the pressing-in notch 99. FIG. 16 shows analysis results. It was found that reaction force from the electric wire 6 is uniformly distributed to each of the above points, as shown in FIG. 16.

Although the insertion part 12 has been applied to the terminal 11 for use in the connector 1 to connect the electrical wire 6 in the above embodiment, this is not restrictive.

For example, as in a Ninth Embodiment shown in FIG. 17(A), the insertion part of the present invention may be applied to a card edge/plug-in connector 71 for inserting an extension card of a PC thereinto.

This insertion part 72 is provided with an insertion groove 73 for inserting an extension card, and a pair of conductive arm parts 74 symmetrically formed with this insertion groove 73 provided therebetween. Since a bow-shaped slit 76 is provided in a base 75 in this insertion part 72, a similar effect can be obtained.

A modified example of the Ninth Embodiment is a case where the insertion groove 73 is formed into a substantially oval shape and the conductive arm part 74 is formed into such a shape as to be approximate to the shape of the beam with uniform strength, as shown in FIG. 17(B). Then, a substantially U-shaped slit 78 is provided so as to surround the insertion groove 73.

On the other hand, as in a Tenth Embodiment shown in FIG. 18(A), the insertion part of the present invention may be applied to a connector connection terminal 81 for connecting a flexible print substrate.

This insertion part 82 is provided with: an insertion groove 83 for inserting a flexible print substrate thereinto (not shown); a fixed piece 84 which extends below the insertion groove 83 and is fixed to a housing (not shown); and a conductive arm part 85 opposed to the fixed piece 84 with the insertion groove 83 provided therebetween. Then, an arc-shaped slit 87 curved so as to surround an end 88 is provided in a base 86 of the insertion groove 83.

Moreover, as a modified example of the Tenth Embodiment, as shown in FIG. 18(B), the conductive arm part 85 of the insertion part 82 may be provided with a J-shaped slit (first slit) 89 extending along the insertion groove 83 and surrounding the end 88, and a curved slit (third slit) 90 curved along the J-shaped slit 89.

As described, the present invention provides a terminal in which an insertion groove for pressing a conductor thereinto is provided between a pair of conductive arm parts, wherein a slit is provided in at least some part around the insertion groove.

With the above configuration, stress generated in the conductive arm part can be dispersed via the slit, and the conductive arm part becomes apt to be elastically deformed. Hence it is possible to prevent stress concentration on a specific place of the terminal, so as to reduce plastic deformation. Accordingly, even when a conductor is once pulled out of the insertion groove and reinserted thereinto, the holding force does not decrease, and the repairability can be held. Further, the conductive arm part becomes apt to be elastically deformed, thereby facilitating pressing-in of the conductor and a connection operation.

The slit may be provided on each side of the insertion groove.

Further, the slit may be a substantially triangular through hole, and a distance from the insertion groove to one side of the through hole may increase sequentially along a direction from the center of a contact part between the conductive arm part and the conductor toward the end at the time of pressing-in of the conductor.

With the above configuration, stress generated in the conductive arm part further becomes constant, and hence plastic deformation is not apt to occur, leading to improvement in repairability.

When X represents a distance from the center of the contact part toward the end and Z represents a section modulus of the conductive arm part at a point of the distance X, Z may be proportional to X.

Therefore, stress that is acted on the cross section at the point of the distance X becomes constant, thereby to allow prevention of plastic deformation.

A plurality of slits may be juxtaposed such that the slit provided in a position closest to the insertion groove has the maximal length and the slits sequentially have smaller lengths as being more distant from the insertion groove.

Accordingly, stress generated in the conductive arm part can be made constant.

A slit may be provided on the deeper side than the end.

Therefore, stress generated in a base of the conductive arm part is dispersed by means of the slit, making the conductive arm part apt to be elastically deformed. Hence it is possible to prevent stress concentration on the base, so as to reduce plastic deformation.

The slit may be a substantially U-shaped first slit surrounding the end of the insertion groove and extending along the insertion groove.

This facilitates elastic deformation of the conductive arm part to reduce the plastic deformation that occurs at the time of applying a load to an opening of the insertion groove, while allowing dispersion of stress that concentrates on the end of the insertion groove.

A second slit may be provided between the outer edge of the conductive arm part and the first slit.

This can further facilitate elastic deformation.

A third slit may be provided on the opposite side to the end of the first slit.

Therefore, stress generated in the base can further be dispersed by means of the slit, making the conductive arm part apt to be elastically deformed.

A notched part with a width larger than a width of the insertion groove may be provided at the end of the insertion groove.

Therefore, by application of a load, force of a vertical component and vertical force generated by the load cancel each other, out of a horizontal component and the vertical component of force generated at each end of the notched part, and hence it is possible to prevent stress concentration at the end of the insertion groove.

A pressing-in notch for pressing and fixing the conductor thereinto may be formed on at least one side of the insertion groove.

Therefore, reaction force by the pressed/fixed conductor is uniformly distributed to the pressing-in notch.

A pair of pressing-in notches for pressing and fixing the conductor thereinto may be formed in opposed positions of the insertion grooves.

Therefore, reaction force by the pressed/fixed conductor is uniformly distributed to the pressing-in notch.

The pressing-in notch may be an arc curved outward.

Therefore, reaction force by the conductor is uniformly distributed to the pressing-in notch in a more reliable manner.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An insulation displacement terminal, comprising:

an U-shaped insertion groove for pressing a conductor thereinto, the U-shaped insertion groove disposed between a pair of conductive arm parts, the U-shaped insertion groove having an open end and a U-shaped end; and slits disposed proximate to the insertion groove, wherein the slits are substantially triangular through-holes, and wherein when the conductor is in a compressed position in the U-shaped insertion groove, a contact part between a conductive arm part and the conductor is created;

a distance from the U-shaped insertion groove to an edge of the substantially triangular through-hole increases sequentially as one moves from a center of the contact part towards the U-shaped end of the U-shaped insertion groove;

wherein the slits are provided on each side of the insertion groove.

2. The terminal according to claim 1, wherein the slit is provided near the end of the insertion groove.

3. The terminal according to claim 1, wherein a separation distance between the pair of conductive arm parts is substantially constant.

4. The terminal according to claim 3, wherein, when X represents a distance from the center of the contact part toward the end and Z represents a section modulus of the conductive arm part at a point of the distance X, Z is proportional to X.

* * * * *